US005893280A

United States Patent [19]

Honda et al.

[11] Patent Number: 5,893,280

[45] Date of Patent: Apr. 13, 1999

[54] SPIN EXTRACTOR

[75] Inventors: Kunioki Honda, Kusatsu; Mitsunori Shinmura, Moriyama; Tetsuo Harada, Koka-gun; Takaaki Yonezawa, Kusatsu, all of Japan

[73] Assignee: Sanyo Electric Co., Ltd., Moriguchi, Japan

[21] Appl. No.: 08/985,120

[22] Filed: Dec. 4, 1997

[30] Foreign Application Priority Data

Dec. 18, 1996 [JP] Japan ..... 8-354520

[51] Int. Cl.[6] ..... D06F 33/02

[52] U.S. Cl. ..... 68/12.06

[58] Field of Search ..... 68/12.06, 23.2

[56] References Cited

U.S. PATENT DOCUMENTS

| | | | |
|---|---|---|---|
| 3,117,926 | 1/1964 | Starr et al. | 68/12.06 X |
| 5,280,660 | 1/1994 | Pellerin et al. | 68/12.06 X |
| 5,765,402 | 6/1998 | Ikeda et al. | 68/12.06 |

FOREIGN PATENT DOCUMENTS

| | | |
|---|---|---|
| A-6-254294 | 9/1994 | Japan . |
| A-7-100095 | 11/1995 | Japan . |
| A-9-10480 | 1/1997 | Japan . |

*Primary Examiner*—Philip R. Coe
*Attorney, Agent, or Firm*—Oliff & Berridge, PLC

[57] ABSTRACT

By rotating a drum at a low speed, the laundry is redistributed so that the eccentric load due to the laundry comes at a position opposing a balancing chamber. Then, while the drum is rotated at a middle speed, a balancing-water supply valve is opened to supply water from a balancing-water nozzle into a water-guiding chamber provided on the back of the drum. The water supplied flows into the balancing chamber, thus increasing the weight of the balancing chamber. The water supply is continued until the magnitude of the eccentric load of the drum holding the laundry and the water becomes smaller than a predetermined value. After an adequate amount of water is supplied, the total eccentric load is so small that the abnormal vibration does not occur even when the drum is rotated at a high speed for extraction.

8 Claims, 8 Drawing Sheets

BEFORE EXTRACTING OPERATION

IN SCATTERING LAUNDRY
(AT SPEED N1)

IN DETECTING ECCENTRIC LOAD
(AT SPEED N2)

IN BALANCING OPERATION
(AT SPEED N3)

SPIN EXTRACTOR

The present invention relates to a spin extractor for extracting liquid, such as water or dry cleaning solvent, from the laundry by rotating a basket drum at high speed with the laundry contained therein about a horizontal axis. The spin extractor of the present invention can be used also in an automatic washing machine or an automatic washing/drying machine that can perform washing, extracting and drying continuously.

BACKGROUND OF THE INVENTION

In a so-called drum type (or a front loading type) spin extractor, wet laundry after being washed are thrown into a basket drum having a horizontal rotation axis from the front opening, and the drum is rotated about the horizontal axis at high speed. When, in the spin extractor of this type, the drum is rotated at high speed with the laundry distributed unevenly therein, abnormal vibration occurs due to the uneven mass distribution around the axis. In conventional washing machines that include such a drum type spin extractor, one or several heavy weights are attached to the tub enclosing the drum for suppressing such an abnormal vibration. This naturally increases the weight of the washing machine, which makes the transportation and more installation difficult.

Several proposals have been made addressing this kind of abnormal vibration of the drum type spin extractors. In the Publication No. H6-254294 of Japanese Unexamined Patent Application, a spin extractor is disclosed in which the laundry is evenly redistributed in the drum by rotating the drum at low speed before rotating it at high speed for extraction. The process in detail is as follows. First the drum is rotated at a very low speed for a very short time, and then it is rotated at a low speed which is a little higher than said very low speed but quite lower than the speed for liquid extraction. By the two-stage rotating operation, the laundry in the drum is redistributed. And the machine is equipped with a vibration sensor on its base. When the sensor detects vibration while the drum is rotated at high speed for extraction, the speed of the drum is lowered.

In the above spin extractor, it is not assured that the laundry is redistributed evenly with a single low-speed rotating operation. If vibration is detected by the sensor when the drum is rotated at high speed for extraction after the low-speed rotating operation, another trial of low-speed rotating operation is necessary to redistribute the laundry. It may take a long time before a thoroughly even distribution is obtained if such trials are repeated several times.

Another disadvantage of the above spin extractor is that an even distribution in the drum is impossible if the laundry in the drum is a single article and is heavy, for example jeans. In this case, vibration cannot be suppressed by the above method.

In the Publication No. H7-100095 of Japanese Examined Patent Application, a spin extractor is disclosed that adjusts the rotating balance using a weight piece attached on a part of the inner wall of the drum. It is assumed in the spin extractor that, while rotated at low speed, the drum is balanced when the weight piece is at the top because the laundry in the drum rests at the bottom naturally because of the gravity, at which time the drum is started and rotates at high speed for extraction.

The complete balancing of the drum is not assured, however, because the weight of the laundry is not always equal to the weight of the weight piece. It is of course possible to balance the weights if the weight of the laundry thrown in the drum is strictly controlled, which is unpractical in actual use of a spin extractor.

SUMMARY OF THE INVENTION

For solving the above problems, the present invention proposes a spin extractor wherein the balance of the drum is adequately regulated irrespective of whether the laundry includes a plurality of articles or only one article, thus avoiding the abnormal vibration or noise assuredly during an extracting operation at high speed.

Thus, the present invention proposes a first spin extractor for extracting liquid from the laundry by rotating a basket drum with the laundry contained therein about a horizontal axis, which includes:

a) a liquid holder formed in a part of the wall of the drum;

b) a liquid guide rotating with the drum for receiving a quantity of liquid supplied from an outside source, for temporarily holding the quantity of liquid and then transferring the quantity of liquid to the liquid holder through an introduction port by means of the centrifugal force;

c) a liquid injector for injecting the quantity of liquid to the liquid guide while the drum is rotated;

d) a speed controller for controlling a motor for rotating the drum;

e) an eccentric load detector for detecting the magnitude and position of an eccentric load of the drum while the drum is rotated at a speed where the centrifugal force acting on the laundry is larger than a gravitational force acting thereon;

f) a determining unit for determining whether the position of the eccentric load detected by the eccentric load detector is in proximity to a position opposing the liquid holder in the drum before the liquid is supplied to the liquid holder; and g) a liquid supply controller for controlling the supply of a quantity of liquid to the liquid holder using the liquid injector so that the magnitude of the eccentric load becomes smaller than a preset value when the determining unit determines that the position of the eccentric load is in proximity to the position opposing the liquid holder in the drum.

In the first spin extractor, the drum itself has no eccentric load when no liquid is held in the liquid holder, whereas, when a liquid is held in the liquid holder, the drum has an eccentric load corresponding to the amount of the liquid.

In the first step of the extraction using the first spin extractor, the laundry is thrown into the drum with no liquid held in the liquid holder, and the rotation of the drum is started. When the drum attains a speed where the centrifugal force acting on the laundry is larger than the gravitational force acting thereon, the laundry is pressed on the inner wall of the drum and rotates with the drum by means of the centrifugal force. Under such a condition, the eccentric load detector detects an eccentric load which occurs due solely to the uneven distribution of the laundry. If the eccentric load thus detected is determined to be located in proximity to the position opposite to (or displaced by 180° from) the liquid holder, the loading balance will be achieved by increasing the weight of the liquid holder. Therefore, the liquid supply controller drives the liquid injector while the drum is rotated, whereby a quantity of liquid is injected to the liquid guide. After being held by the liquid guidc temporarily, the liquid flows through the introduction port into the liquid holder.

While the liquid is being supplied to the liquid holder, the eccentric load detector continues the detection of the eccentric load. The liquid supply controller continues supplying the liquid until the eccentric load becomes smaller than a preset value. Thus, the eccentric load due to the uneven distribution of the laundry is almost cancelled by balancing the laundry with the liquid in the liquid holder, so that the abnormal vibration is suppressed even during a high speed extracting operation.

As described above, the first spin extractor carries out the high speed extracting operation after the eccentric load due to an uneven distribution of the laundry is almost cancelled by changing the amount of the liquid held in the liquid holder, whereby the abnormal vibration or noise is prevented assuredly during the high speed extracting operation. When, for example, the laundry contained in the drum consists of a single article having a relatively large weight, it is impossible to distribute the laundry evenly on the inner wall of the drum. Even in such a case, the eccentric load can be almost cancelled by means of the liquid holder.

The second spin extractor according to the present invention is characterized in that:

the liquid guide is a hollow disk fixed on the back of the drum, and the liquid guide has an opening for the liquid inlet at around the horizontal axis on the side away from the drum; and the liquid injector includes a water injector fixed at such a position that a water ejected therefrom enters the liquid guide through the opening.

In the second spin extractor, when water is ejected from the water injector, the water enters the liquid guide rotating with the drum. In the liquid guide, the water is impelled along the circumferential inner wall of the liquid guide by the centrifugal force, and flows into the liquid holder through the introduction port provided near the circumference. Thus, the water is efficiently introduced into the liquid holder so that the weight of the liquid holder is increased to a desired value in a short period of time. Accordingly, the start of the high speed extracting operation can be advanced.

The third spin extractor according to the present invention is characterized in that the speed controller controls the motor so that the drum is rotated at a speed where the centrifugal force acting on the laundry is smaller than the gravitational force acting thereon when the determining unit determines that the position of the eccentric load is not in proximity to the position opposing the liquid holder in the drum in order to redistribute the laundry.

When the position of the eccentric load due to the uneven distribution of the laundry is not in proximity to the position opposing the liquid holder, the eccentric load cannot be balanced by introducing liquid into the liquid holder. In such a case, the third spin extractor lowers the speed of the drum to a speed where the centrifugal force acting on the laundry is smaller than the gravitational force so that the laundry is scattered in the drum. After the laundry is redistributed by the above process, the speed of the drum is raised to determine the state of the eccentric load again. By such an operation, the distribution of the laundry is changed properly so that the eccentric load comes to a position appropriate for balancing the eccentric load using the liquid holder. Thus, preventing the abnormal vibration assuredly, the extracting operation can be started promptly irrespective of the amount, type etc., of the laundry.

The fourth spin extractor according to the present invention is characterized in that the speed controller controls the motor to rotate the drum at a high speed to carry out the extraction with no liquid held in the liquid holder when the magnitude of the eccentric load detected by the eccentric load detector is smaller than the preset value before the liquid is introduced into the liquid holder.

When the laundry is scattered almost evenly on the inner wall of the drum and the magnitude of the eccentric load is smaller than the preset value, there is no need to balance the eccentric load using the liquid holder. In such a case, the fourth spin extractor raises the speed of the drum to the high speed for carrying out the extracting operation without introducing the liquid into the liquid holder. Thus, the extracting operation can be started promptly when there is no need to balance the eccentric load, whereby the efficiency of extraction is enhanced.

The fifth spin extractor according to the present invention is characterized in that:

the liquid guide has a discharge port formed in the position opposing that of the introduction port; and the speed controller stops the drum with the liquid holder posed at the top thereof after the extracting operation is completed.

After the extracting operation is carried out with the liquid held in the liquid holder, it is necessary to discharge the liquid from the liquid holder so that the drum itself has no eccentric load at the start of the next extracting operation. In the fifth spin extractor, therefore, a discharge port is provided in the circumferential wall of the liquid guide in opposition to the introduction port. When the drum is stopped with the liquid holder posed at the top of the drum, the liquid in the liquid holder flows back into the liquid guide through the introduction port since the centrifugal force no longer acts on the liquid. The liquid, then, flows downward in the liquid guide and is discharged through the discharge port posed at the lower part of the liquid guide. Thus, the drum is restored to its original state where the drum itself has no eccentric load, whereby the process of balancing the eccentric load using the liquid holder is carried out reliably also in the next extracting operation.

The sixth spin extractor according to the present invention is characterized in that the liquid holder is formed in one of baffles provided in the drum.

In a conventionally used spin extractor, a plurality of baffles bulging inward are provided on the inner wall of the drum for lifting and shuffling the laundry. Taking account of this, in the sixth spin extractor, one of the baffles is used as the liquid holder, thus the structure is simplified.

The seventh spin extractor according to the present invention is characterized in that:

the introduction port is located closer to the rotation axis of the drum than the liquid holder; and a conduit is formed to connect the introduction port and an inlet port formed in the liquid holder at the side facing the rotation axis of the drum.

When the seam between the liquid guide and the liquid holder is covered with the liquid held by means of the centrifugal force during the extracting operation, the liquid leaks through the seam since the centrifugal force acting on the liquid is very strong when the drum is rotated at high speed. In view of this, in the seventh spin extractor, the introduction port is located closer to the central axis of the drum than the liquid holder, and a conduit is formed to connect the introduction port and a port formed in the liquid holder at the side facing the rotation axis of the drum. When the drum is rotated, the liquid supplied to the liquid guide experiences a centrifugal force, flows into the liquid holder through the conduit, and is impelled against the inner wall of the drum. Here, the above-described leakage of the liquid does not occur even when the liquid holder is almost filled with the liquid since the seam is located closer to the rotation axis of the drum than the port of the liquid holder. By preventing the leakage of the liquid as described above, the amount of the liquid held in the liquid holder is kept unchanged, so that the load balance of the drum is maintained assuredly until the end of the extracting operation. Of course, there is no need to seal the seam with a special sealant.

The eighth spin extractor according to the present invention is characterized in that the part of the conduit connected to the liquid holder is formed into a taper passage whose cross sectional area increases toward the liquid holder.

In the eighth spin extractor, when the drum is stopped in the end of the extracting operation, it is assured that the liquid held in the liquid holder flows back into the liquid guide through the conduit and is discharged from the discharge port even if the liquid holder is somewhat displaced from the top of the drum since the part of the conduit connected to the port of the liquid holder is formed into a taper passage whereby the liquid is smoothly introduced back into the conduit.

BRIEF DESCRIPTION OF THE DRAWINGS

Preferred embodiments of the present invention will be described below, referring to the attached drawings wherein.

DETAILED DESCRIPTION OF A PREFERRED EMBODIMENT

Figure 1:
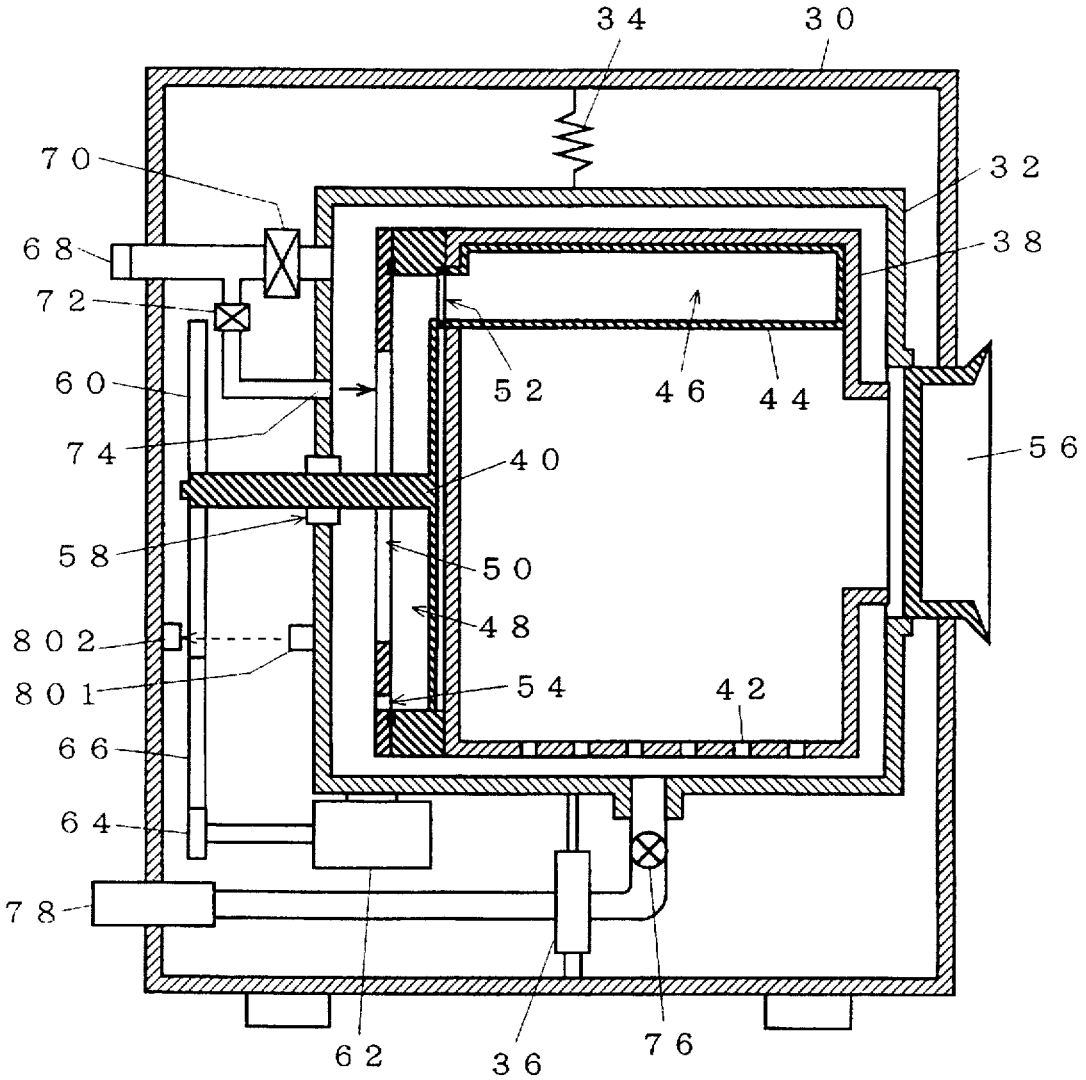
FIG. 1 is a vertical sectional view of a drum type washing machine including a spin extractor embodying the present invention, viewed from the side.
Figure 2:
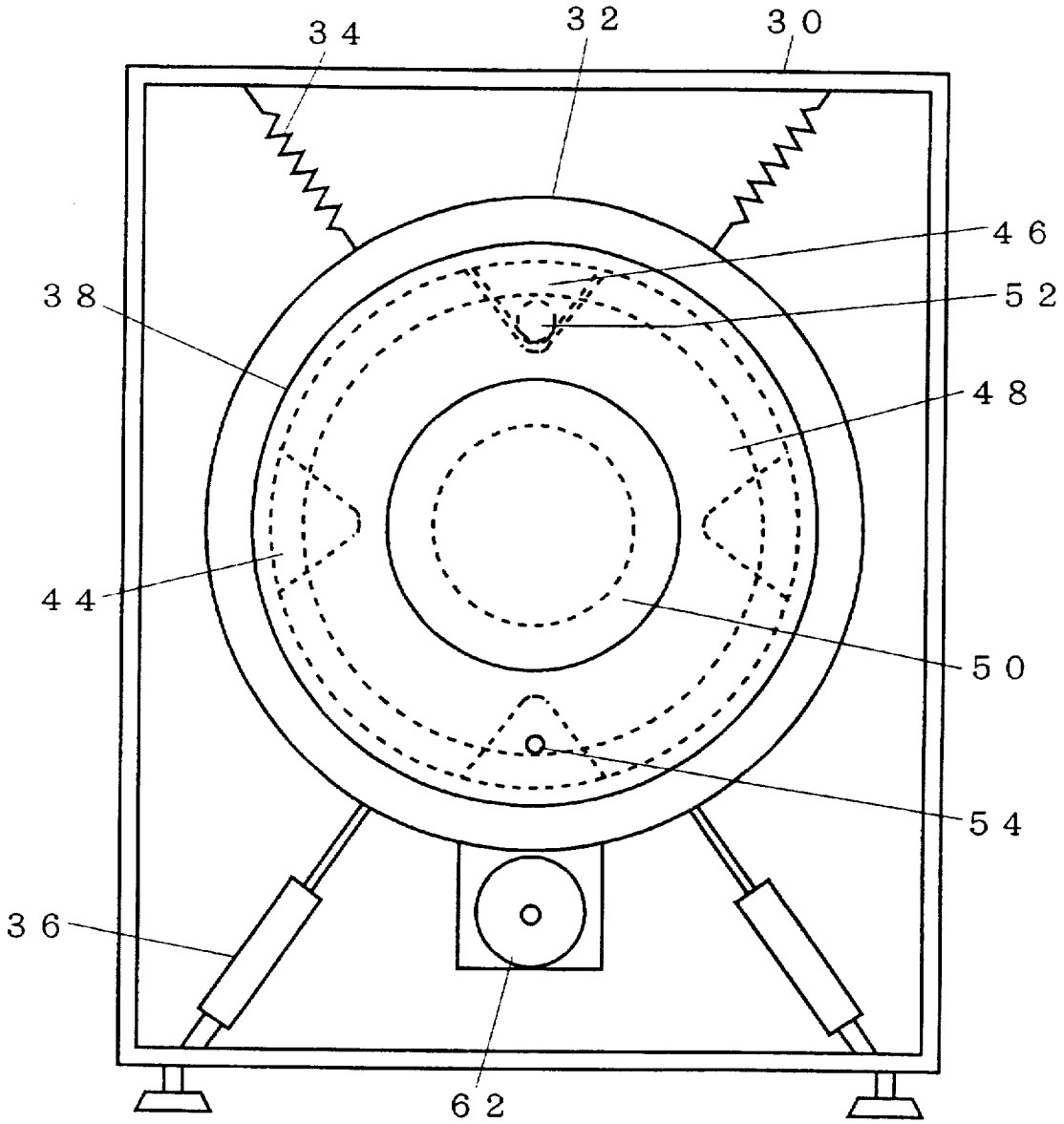
FIG. 2 is a back view of the drum type washing machine with its back panel removed.

FIGS. 1 and 2 show the structure of a drum type washing machine including a spin extractor embodying the present invention. In the washing machine, a tub 32 is supported by a spring 34 and a damper 36 in a frame 30. A drum 38 has a main shaft 40 on its back, and the main shaft 40 is borne by the tub 32. The drum 38 has a number of perforations 42 in the peripheral wall. When water is supplied into the tub 32, the water enters the drum 38 through the perforations 42, and when the drum 38 is rotated for extracting water from the laundry, the water extracted is centrifugally displaced through the perforations 42 into the tub 32. On the inner peripheral wall of the drum 38 are provided four baffles 44 at angular intervals of 90° for lifting and shuffling the laundry, as shown in FIG. 2. One of the four baffles 44 functions as a balancing chamber 46 for holding water inside. On the back of the drum 38 is provided a water-guiding chamber 48, which is the hollow disk. The water-guiding chamber 48 has a water inlet 50 which is a large circular opening around the main shaft 40. A water introduction port 52 provided in the water-guiding chamber 48 conveys water to the balancing chamber 46. A discharge port 54 in the water-guiding chamber 48 is located to oppose to the water introduction port 52 diametrically across the main shaft 40. The frame 30 has a door 56 for closing the front opening of the tub 32. The door 56 is opened when the laundry is thrown into or taken out of the drum 38.

The main shaft 40 is borne by a bearing 58 fixed in the tub 32, and a main pulley 60 is fixed to the end of the main shaft 40. Under the tub 32 is disposed a motor 62 having a shaft on which a motor pulley 64 is fixed. The motor pulley 64 is drivingly connected with the main pulley 60 by a V-belt 66.

A water supply port 68 is provided in the back of the frame 30. Part of the water supplied from the water supply port 68 flows via a water supply valve 70 into the tub 32, and the other part of the water flows through a balancing-water supply valve 72 and is ejected from a balancing-water nozzle 74 provided in the back of the tub 32. The water in the tub 32 is drained through a drain outlet 78 to the outside by opening a drainage valve 76. The drainage mechanism may be otherwise constructed using a pump that forces water out of the tub 32 instead of the drainage valve 76.

A photo-emitter 801 and a photo-receiver 802 are disposed across the main pulley 60 to constitute a rotation sensor. In the rim of the main pulley 60 is provided an opening in a position between the photo-emitter 801 and photo-receiver 802. Light emitted from the photo-emitter 801 passes through the opening in the rim and reaches the photo-receiver 802 once in each rotation of the drum 38. Thus, the photo-receiver 802 generates a detection signal synchronized with the rotation of the drum 38. The signal is used as a rotation marker which will be mentioned later.

Figure 3A:
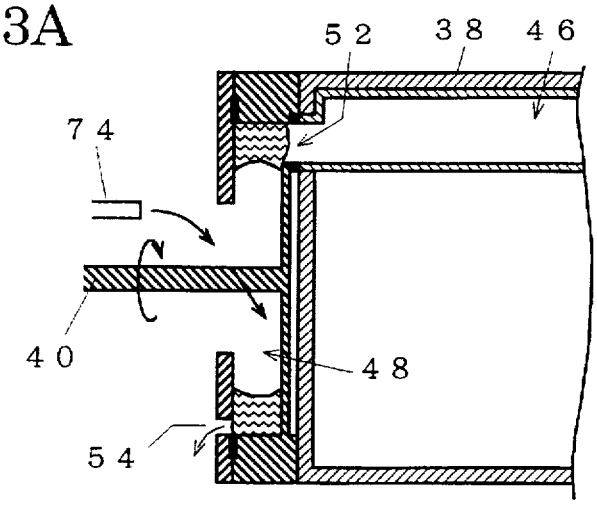
FIGS. 3A–3C are illustrations showing steps of supplying water to a balancing chamber and discharging water from the balancing chamber in the spin extractor.
Figure 3B:
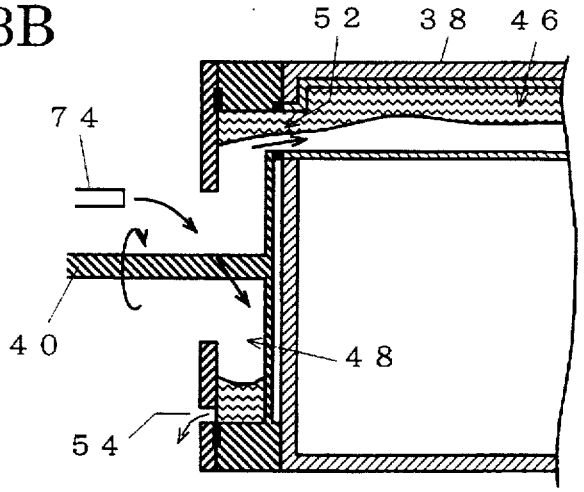
Figure 3C:
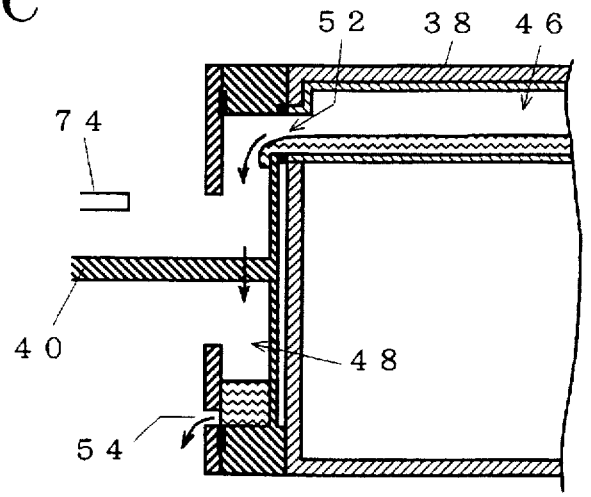

Referring to FIGS. 3A–3C, the process of supplying water to the balancing chamber 46 and discharging water from the balancing chamber 46 is detailed as follows. FIGS. 3A–3C show the vertical sections of a part of the spin extractor including the water-guiding chamber 48, illustrating the flow of a water. When water is ejected from the balancing-water nozzle 74 while the drum 38 is rotated at a speed higher than predetermined, the water ejected enters the water-guiding chamber 48 through the water inlet 50. Here, the water inlet 50 is maintained in the same position while the drum 38 is rotating because the water inlet 50 is provided at around the rotation axis of the drum 38. Therefore, it is easy to eject the water from the balancing-water nozzle 74 into the water inlet 50 by setting the water supply pressure properly. Further, there is little possibility that the water fails to enter the water-guiding chamber 48 even when the direction of the ejected water changes due to the change in the water supply pressure because the water inlet 50 is adequately large. The water supplied to the water-guiding chamber 48 is impelled toward the circumferential wall and held thereon by the centrifugal force (see FIG. 3A).

The water introduction port 52 provided near the circumferential wall of the water-guiding chamber 48 leads to the balancing chamber 46. The balancing chamber 46 is a hollow member located radially away from the main shaft 40 and projecting above the main axis of the water introduction port 52. Due to the centrifugal force, therefore, the water supplied to the water-guiding chamber 48 is further impelled and introduced through the water introduction port 52 and into the balancing chamber 46, to its outermost extremity (i.e. the inner wall of the drum 38). Therefore, when the drum 38 is rotated at a speed where the centrifugal force acting on the water in the balancing chamber 46 is larger than the gravitational force, the water is prevented from flowing back into the water-guiding chamber 48 through the water introduction port 52. When the amount of water is significantly large, the water is held by both the balancing chamber 46 and the water-guiding chamber 48 over the water introduction port 52 (see FIG. 3B). Part of the water in the water-guiding chamber 48 leaks out from the water-guiding chamber 48 through the discharge port 54. The amount of the leaking water, however, is very small compared to the amount of the water held in the balancing chamber 46, so that it does not significantly influence the balance control which will be detailed later.

When the water held in the balancing chamber 46 and the water-guiding chamber 48 is to be discharged, the drum 38 is stopped so that the balancing chamber 46 is posed at the top of the drum 38. There, the water in the balancing chamber 46 flows back into the water-guiding chamber 48 via the water introduction port 52 since the centrifugal force no longer acts upon the water. Thus, the water is collected at the bottom of the water-guiding chamber 48 and is discharged through the discharge port 54 to the inside of the tub 32 (see FIG. 3C). The drum 38 is posed in the above-described state until all the water in the balancing chamber 46 and the water-guiding chamber 48 is discharged.

Figure 4:
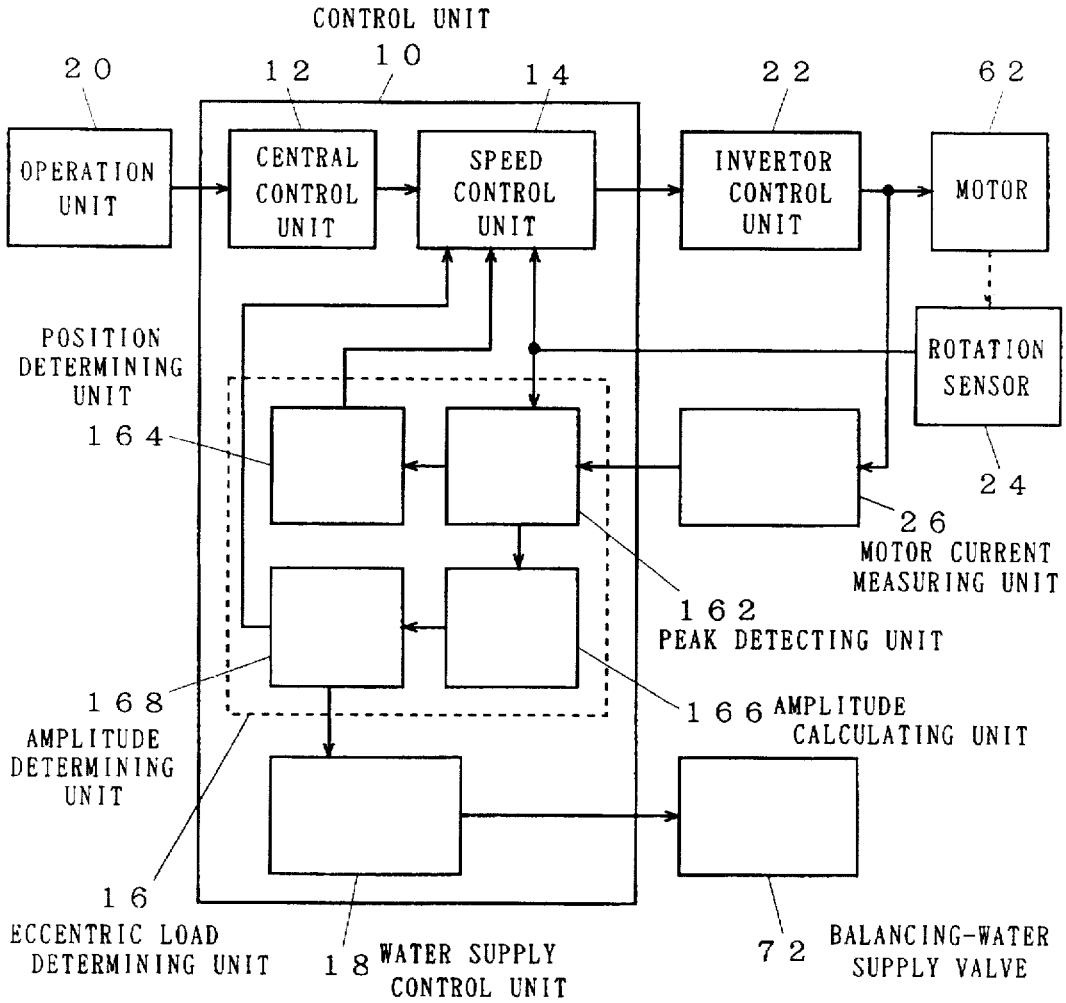
FIG. 4 is a block diagram of the electrical system of the spin extractor.

Referring to FIG. 4, the constitution and operation of the electrical system relevant to the extracting operation in the washing machine is described below. A control unit 10 composed of one or several microcomputers and peripheral devices include a central control unit 12, a speed control unit 14, an eccentric load determining unit 16, a water supply control unit 18, etc. The eccentric load determining unit 16 consists of several units including a peak detecting unit 162, a position determining unit 164, an amplitude calculating unit 166 and an amplitude determining unit 168. The central control unit 12 includes a memory (not shown), where an operation program for conducting an extracting operation is stored beforehand. When a user operates a key or keys on an operation unit 20 to select one of several extraction modes according to, for example, the type of constituent fabric of the laundry, and to start an operation, the central control unit 12 reads out a program corresponding to the selected mode from the memory and executes the program to perform an extracting operation which will be described later.

The speed control unit 14 generates a rotation speed designating signal for designating the speed and direction to the drum rotation, which is sent to an invertor control unit 22. The invertor control unit 22 converts the signal into a pulse width modulated (PWM) signal and applies a voltage to the motor 62 corresponding to the PWM signal. The electric current to the motor 62 is measured by a motor current measuring unit 26, which generates a detection signal corresponding to the magnitude of the electric current and sends the signal to the eccentric load determining unit 16.

Figure 5:
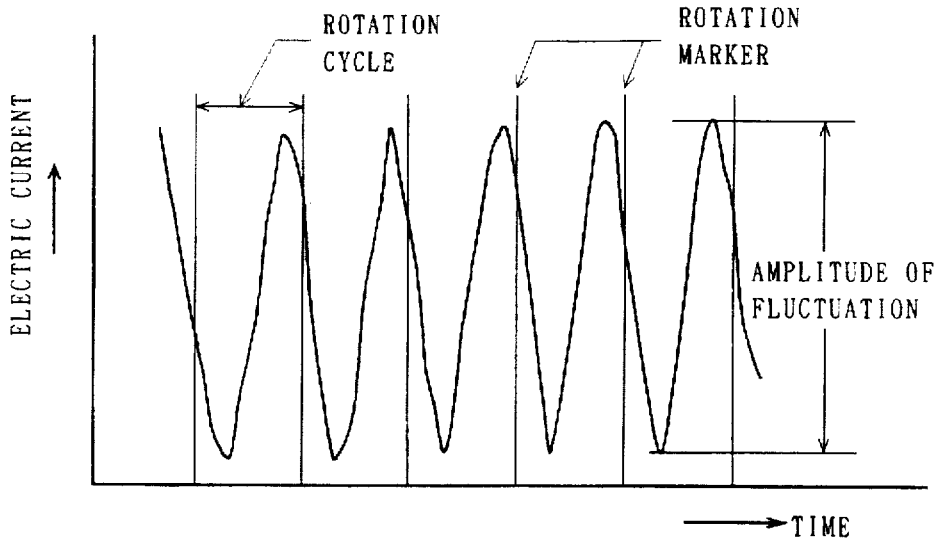
FIG. 5 is a graph showing an example of the motor current fluctuating in magnitude.

If there is an eccentric load in the drum 38, the fluctuation occurs in the motor current depending on the magnitude and position of the eccentric load. FIG. 5 shows an example of a waveform representing the effective value of the motor current measured when there is an eccentric load. In FIG. 5, the rotation marker is a signal generated by the rotation sensor 24 as described above at each rotation of the drum 38.

The fluctuation in the motor current is caused by the fluctuation in the load torque on the motor 62, and a maximum peak of the motor current appears at the time point where the load torque on the motor 62 is largest in each rotation of the drum 38. If the eccentric load is mainly caused by an uneven distribution of the laundry, the load torque on the motor 62 is maximized when the baffle 44 in the drum 38 is lifting the laundry upward against gravity. Therefore, normally, the maximum peak of the motor current appears when the eccentric load passes a point somewhat displaced before the top of the drum 38.

Figure 6:
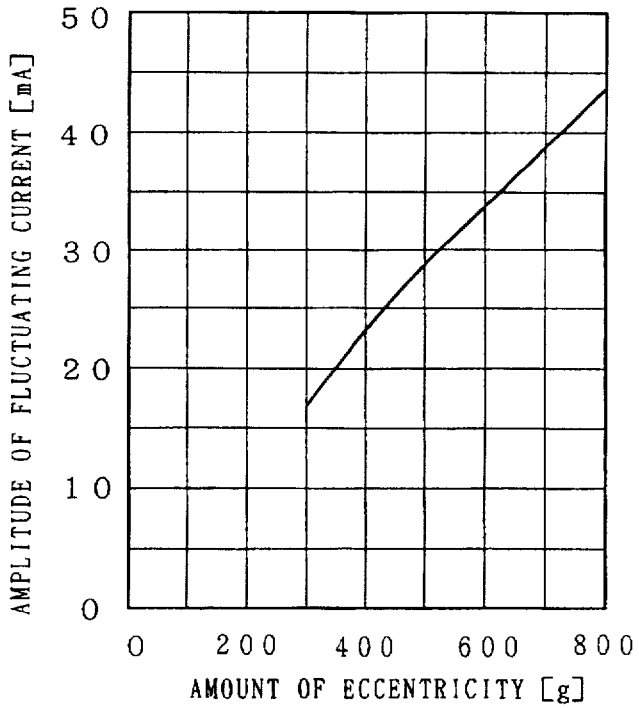
FIG. 6 is a graph showing an example of the relation between the magnitude of the eccentric load and the amplitude of fluctuations in the motor current.

The amplitude of the fluctuation in the motor current corresponds to the magnitude of the eccentric load. FIG. 6 is a graph showing an example of the relation between the magnitude of the eccentric load (or the amount of eccentricity) and the amplitude of the fluctuation in the motor current. The relation is determined beforehand, and is used for calculating the amount of eccentricity from the amplitude of the fluctuation. It should be noted hereby that the fluctuation in the motor current may be caused by various factors other than the eccentric load. Therefore, it is preferable to extract the component having a frequency close to that of the rotation of the drum 38 from the fluctuation in the motor current.

The eccentric load determining unit 16 carries out a detection and determination of the eccentric load as follows, based on the output of the motor current measuring unit 26. The peak detecting unit 162 detects a maximum peak and a minimum peak of the fluctuation in the motor current for every interval of the rotation markers, i.e. for every rotation cycle of the drum 38. Data of the position of the maximum peak is sent to the position determining unit 164, and data of the peak values of the maximum and minimum peaks are sent to the amplitude calculating unit 166. The position determining unit 164 calculates the position of the eccentric load based on the data of the position of the maximum peak and determines whether the position calculated is within a predetermined admissible range including a position opposing the balancing chamber 46 by 180°. The above admissible range is predetermined beforehand taking account of the error of detecting the position, the admissible unevenness in the distribution of the laundry, etc.

The amplitude calculating unit 166 calculates the amplitude of the motor current for every rotation cycle of the drum 38 based on the maximum and minimum peak values. The amplitude determining unit 168 compares the amplitude to a preset reference value, and determines whether magnitude of the eccentric load is adequately small. The reference value of amplitude is preset taking account of the largest amount of eccentricity that does not cause an abnormal vibration during a high speed extracting operation.

The result of determination by the position determining unit 164 is sent to the speed control unit 14, and the result of determination by the amplitude determining unit 168 is sent to the speed control unit 14 and the water supply control unit 18. When the speed control unit 14 receives the results of determinations on the position and magnitude of the eccentric load while controlling the motor 62 to rotate the drum 38 at a predetermined speed, the speed control unit 14 changes the speed designating signal according to the results. The water supply control unit 18 controls the on/off operation of the balancing-water supply valve 72 according to the result of determination on the magnitude of the eccentric load.

Figure 7:
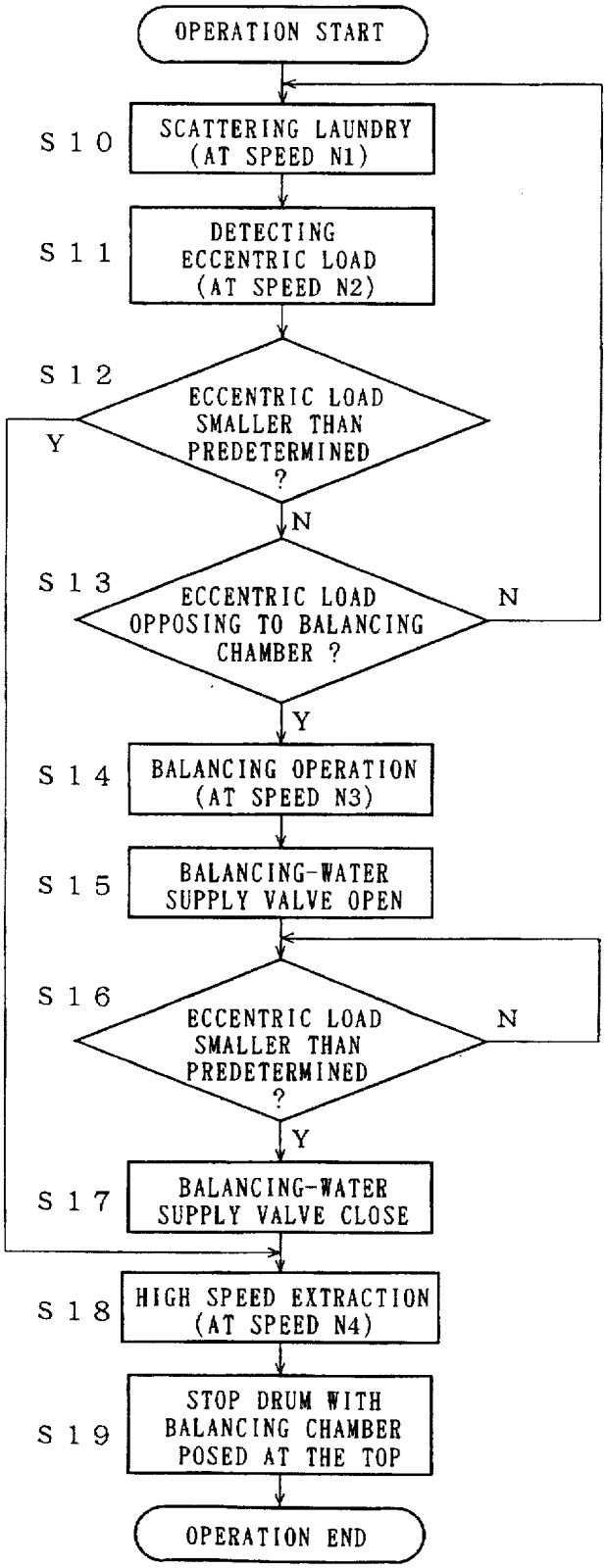
FIG. 7 is a flow chart showing the control steps of the extracting operation by the spin extractor.

The control process of the extracting operation by the above washing machine is described below, referring to FIGS. 7 and 8.

Figure 8A:
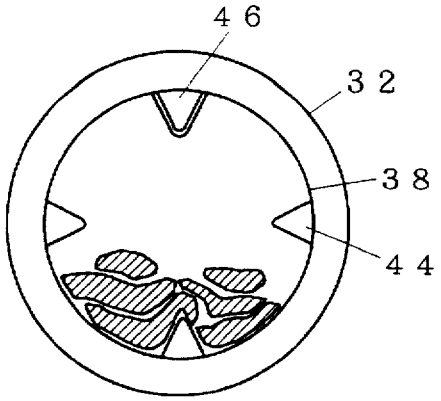
FIGS. 8A–8D are illustrations showing the change in the distribution of the laundry in the drum of the spin extractor.
Figure 8B:
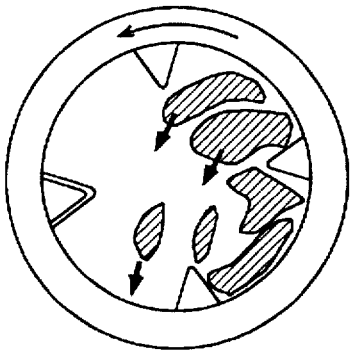

After a washing process is completed, the laundry articles are crammed and piled on the lower part of the drum 38, as shown in FIG. 8A. Here, the drum 38 itself has no eccentric load since the balancing chamber 46 is empty.

When the user operates the operation unit 20 to start the extracting operation, the speed control unit 14 energizes the motor 62 to carry out a scattering operation for agitating the laundry to be scattered on the inner wall of the drum 38 (Step S10). That is, the speed control unit 14 generates a speed designating signal for rotating the drum 38 at a first low speed N1 where the centrifugal force acting on the laundry is smaller than the gravitational force, and the invertor control unit 22 applies a voltage to the motor 62 according to the signal. Here, it is preferable to vary the speed over a predetermined range, taking account of the diameter of the drum during the scattering operation. For example, when the diameter of the drum is 450[mm], it is at about 62[r.p.m.] that the centrifugal force is balanced with the gravitational force on the surface of the inner wall of the drum. Accordingly, the speed N1 of the drum is gradually raised from 55[r.p.m.] to 100[r.p.m], for example. By such a scattering operation, the laundry is agitated as the speed of the drum 38 is varied, whereby the laundry is loosened and redistributed to a certain extent (see FIG. 8B).

After carrying out the scattering operation, an eccentric load detecting operation is carried out for detecting and determining the magnitude and position of the eccentric load due to the uneven distribution of the laundry (Step S11). That is, the speed control unit 14 generates a speed designating signal for rotating the drum 38 at a second low speed N2 which is a little higher than the speed where the centrifugal force acting on the laundry is equal to the gravitational force, and the inverter control unit 22 applies a voltage to the motor 62 according to the signal. When, for example, the diameter of the drum is 450[mm], the speed N2 is preferably 100–140[r.p.m.].

Figure 8C:
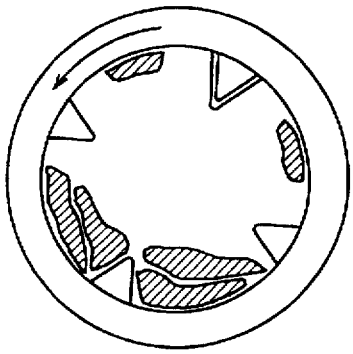
Figure 8D:
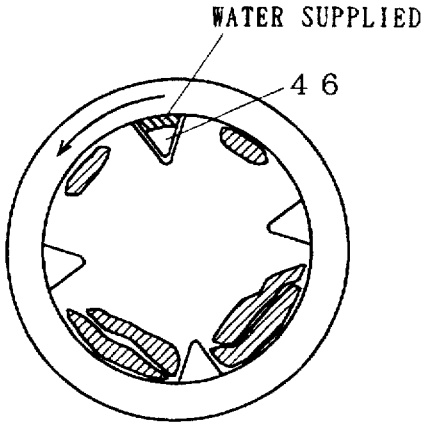

When the drum 38 is rotated at the speed N2, all the laundry is pressed onto the inner wall of the drum 38 by the centrifugal force (see FIG. 8C). Meanwhile, in the eccentric load determining unit 16, the magnitude of the eccentric load is detected based on the amplitude of the fluctuation in the motor current measured by the motor current measuring unit 26, and the position of the eccentric load is detected based on the peak positions in the fluctuation in the motor current, as described above. The amplitude determining unit 168 determines whether the magnitude of the eccentric load is smaller than the predetermined value (Step S12). When the magnitude of the eccentric load is determined to be smaller than the predetermined value, it is concluded that the laundry in the drum 38 has been scattered evenly by the scattering operation, so that the operation proceeds to Step S18, where the high speed extracting operation is carried out, as described above.

On the other hand, when the magnitude of the eccentric load is determined to be larger than the predetermined value in Step S12, the operation proceeds to Step S13, where the position determining unit 164 determines whether the position of the eccentric load is in the predetermined admissible range including the position opposing the balancing chamber 46 by 180°. In Step S13, when the position of the eccentric load is determined to be out of the admissible range, the speed control unit 14 generates a speed designating signal for lowering the speed of the drum 38 so that the scattering operation is carried out again.

On the other hand, when the position of the eccentric load is determined to be in the admissible range in Step S13, the operation proceeds to Step S14, where a balancing operation is carried out. That is, the speed control unit 14 generates a speed designating signal for rotating the drum 38 at a middle speed N3, and the invertor control unit 22 applies a voltage according to the signal. The middle speed N3 is preset to be higher than the speed N2 and lower than a resonance speed where the drum 38 containing the laundry generates a resonance. The resonance speed of the drum 38 depends not only on the weight of the drum 38 itself but also on the weight of the laundry, where it is necessary to take account of the fact that the weight of the laundry significantly changes depending on the amount of water held therein. When the diameter of the drum 38 is 450[mm], the resonance speed is about 200[r.p.m.], so that the middle speed N3 is preset at 150[r.p.m.], for example.

When the drum 38 attains the middle speed N3, the water supply control unit 18 opens the balancing-water supply valve 72 (Step S15), whereby water is ejected from the balancing-water nozzle 74, and the water flows into the balancing chamber 46 gradually. The water is held in the balancing chamber 46, being impelled against the inner wall of the drum 38 by the centrifugal force (see FIG. 8D). Meanwhile, the magnitude of the eccentric load is detected in the eccentric load determining unit 16. The amplitude of the motor current calculated by the amplitude calculating unit 166 becomes smaller and smaller since the eccentric load due to the laundry being pressed on the inner wall of the drum 38 is gradually balanced with the balancing chamber 46 whose weight increases as the water flows into it.

Then, when the amplitude determining unit 168 determines that the amplitude of the fluctuation in the motor current is smaller than the preset reference value in Step S16, the water supply control unit 18 closes the balancing-water supply valve 72 (Step S17), whereby the increase in the weight of the balancing chamber 46 is stopped. Thus, the eccentric load due to the uneven distribution of the laundry is almost balanced with the balancing chamber 46 holding the water, so that a desirable load balance is obtained as a whole. It is recommendable to determine the timing of stopping the water supply (i.e. to determine the reference value for the amplitude used in Step S16) taking account of the fact that, the weight of the balancing chamber 46 increases to some extent even after the water supply is stopped because most of the water residing in the water-guiding chamber 48 at the moment of stopping the water supply, flows into the balancing chamber 46.

After the load balance is obtained as described above, the speed of the drum 38 is raised to carry out the high speed extracting operation (Step S18). That is, the speed control unit 14 generates a speed designating signal for rotating the drum 38 at a high speed N4, and the invertor control unit 22 applies a voltage to the motor 62 according to the signal. The high speed N4 is normally set at about 1000[r.p.m.], where the extracting efficiency is adequately high. More preferably, however, the high speed N4 is set at a smaller value depending on the extraction mode selected by the user in order to prevent fragile fabric articles from being damaged. By rotating the drum 38 at the high speed N4, most of the water held in the laundry is extracted therefrom by means of the centrifugal force. Thus, the extraction of water from the laundry is performed adequately.

After a preset time period for the extracting operation to elapse, the speed control unit 14 controls the invertor control unit 22 to slow down the motor 62. After the speed of the drum 38 is lowered adequately, the speed control unit 14 controls the invertor control unit 22 so that the drum 38 is stopped completely with the balancing chamber 46 posed at the top of the drum 38 (Step S19). By stopping the drum 38 as described above, the water in the balancing chamber 46 flows back through the water introduction port 52 into the water-guiding chamber 48 and is discharged from the discharge port 54 into the tub 32. By discharging all the water from the balancing chamber 46, the drum 38 is restored to its original state where the drum 38 itself has no eccentric load, whereafter the next extracting operation is started, if necessary.

A modification of the washing machine including the inventive spin extractor is described below, referring to FIGS. 9 and 10.

In the spin extractor in FIG. 1, the water introduction port 52 is formed to extend from the end of the balancing chamber 46 horizontally. Therefore, when a large amount of water is supplied, the water is held not only by the balancing chamber 46 but also by the water-guiding chamber 48 over the water introduction port 52, as shown in FIG. 3B. When the drum 38 is rotated at a high speed with a large amount of water held as described above, the water experiences a large centrifugal force, so that some of the water leaks through the seam between the drum 38 and the component member of the water-guiding chamber 48, or through the seam between neighboring component members of the water-guiding chamber 48. For preventing such a leakage, it is necessary to apply a seal to the seams where water appears to leak easily. Further, the amount of water leaking out from the discharge port 54 must be taken into account when the extracting operation is continued for a long time. It is not recommendable to make the discharge port 54 very small for the purpose of preventing the water from leaking therethrough because a small port is easily clogged by suspended solids or the like in the water, thus resulting in problematic water discharge. The small port is also problematic in that the water discharge is prevented by the surface tension of the water itself.

Figure 9:
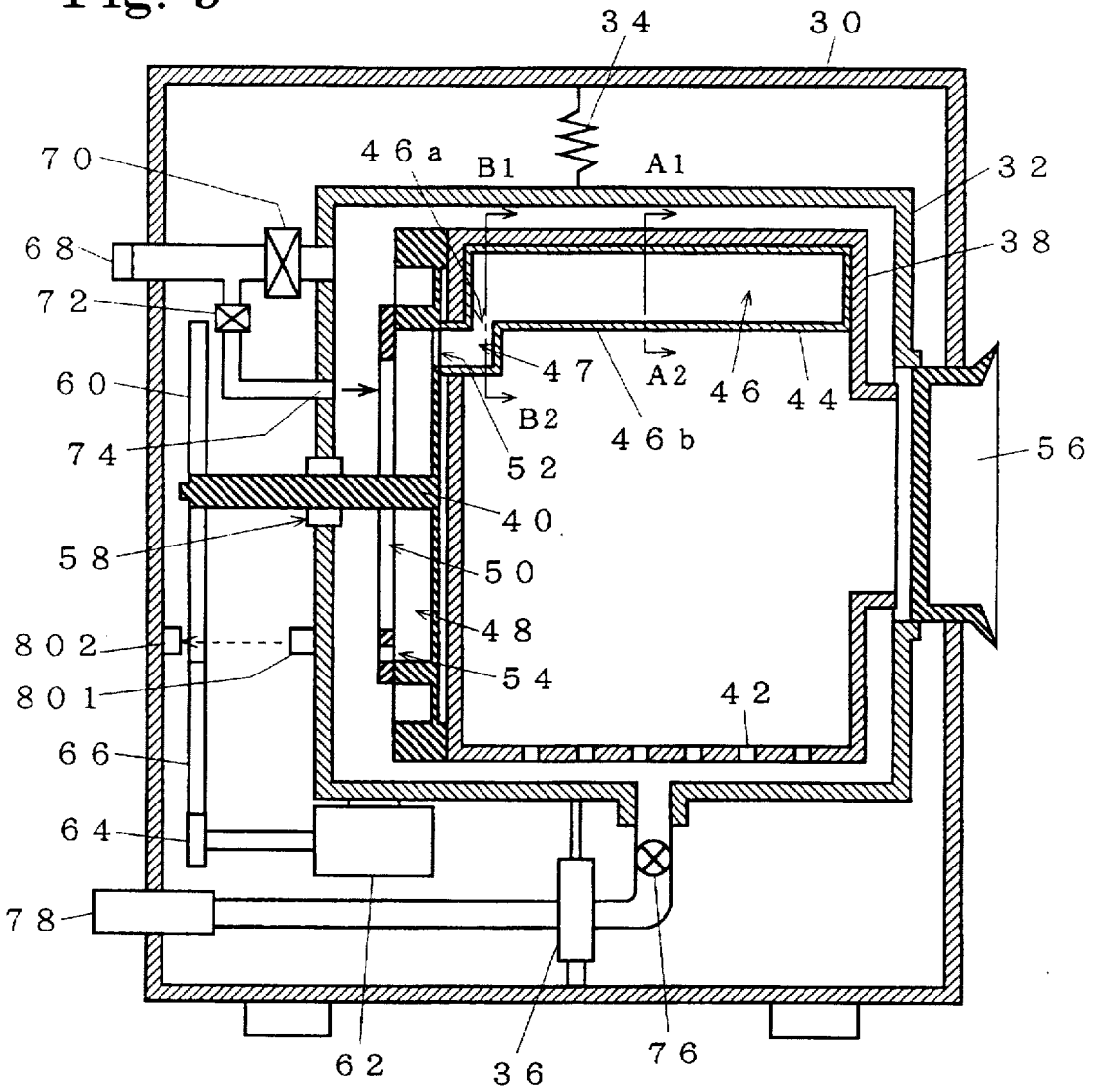
FIG. 9 is a vertical sectional view of another drum type washing machine including another spin extractor embodying the present invention, viewed from the side.
Figure 10A:
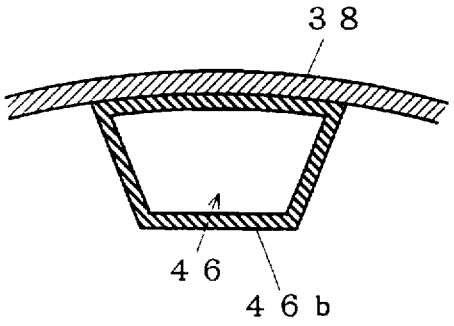
FIG. 10A is a vertical sectional view of the balancing chamber at the line A1–A2 in FIG. 9.

FIG. 9 is a cross section of a drum type washing machine including a spin extractor having an improved structure for supplying water to the balancing chamber 46, viewed from the side, and FIGS. 10A and IOB are vertical sectional views of the balancing chamber 46 at the line A1-A2 and line B1-B2 in FIG. 9, respectively. In the present spin extractor, the balancing chamber 46 has an inlet port 46*a* provided at the side 46*b* facing the rotation axis of the drum 38, and the water introduction port 52 is located closer to the rotation axis than the inlet port 46*a* of the balancing chamber 46. From the inlet port 46*a* of the balancing chamber 46 extends an L-shaped water conduit 47 which leads to the water introduction port 52. Under such a structure, no water is held over the seam between neighboring component members of the water-guiding chamber 48 until the balancing chamber 46 is completely filled with the water. Therefore, compared to the balancing chamber 46 in FIG. 1, the balancing chamber 46 in FIG. 9 can hold a larger amount of water even without a seal for preventing the water leakage. The leakage of water from the discharge port 54 is also prevented effectively since no water is held in the water-guiding chamber 48 until the balancing chamber 46 is filled with the water.

Figure 10B:
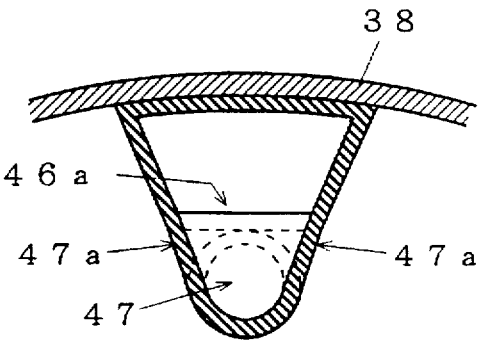
FIG. 10B is a vertical sectional view of the balancing chamber at the line B1–B2 in FIG. 9.

Another feature of the above structure is that the water conduit 47 has a pair of side walls 47*a* forming a taper at the part connected to the inlet port 46*a* of the balancing chamber 46, as shown in FIG. 10B. By designing the water conduit 47 as described above, it is assured that the water held in the balancing chamber 46 flows back through the water conduit 47 into the water-guiding chamber 48 and is discharged from the discharge port 54 even if the balancing chamber 46 is not posed exactly at the top of the drum 38 when the drum 38 is stopped for discharging the water.

Though the above embodiments mainly include descriptions on the drum type washing machine, it should be obviously understood that the present invention can be applied to some other appliances, e.g. a dry cleaner using a petroleum solvent.

What is claimed is:

1. A spin extractor for extracting liquid from laundry by rotating a basket drum with the laundry contained therein about a horizontal axis, which includes:

a) a liquid holder formed in a part of the wall of the drum;

b) a liquid guide rotating with the drum for receiving a quantity of liquid supplied from an outside source, for temporarily holding the quantity of liquid and for then transferring the quantity of liquid to the liquid holder through an introduction port by means of the centrifugal force generated by the rotating drum;

c) liquid injecting means for injecting the quantity of liquid to the liquid guide while the drum is rotated;

d) speed controlling means for controlling a motor for rotating the drum;

e) eccentric load detecting means for detecting the magnitude and position of an eccentric load of the drum while the drum is rotated at a speed where the centrifugal force acting on the laundry is larger than a gravitational force acting thereon;

f) determining means for determining whether the position of the eccentric load detected by the eccentric load detecting means is in proximity to a position opposing the liquid holder in the drum before the liquid is supplied to the liquid holder; and g) liquid supply controlling means for controlling the supply of a quantity of liquid to the liquid holder using the liquid injecting means so that the magnitude of the eccentric load becomes smaller than a preset value when the determining means determines that the position of the eccentric load is in proximity to the position opposing the liquid holder in the drum.

2. The spin extractor according to claim 1, characterized in that:

the liquid guide is a hollow disk fixed on the back of the drum, and the liquid guide has a liquid inlet opening at around the horizontal axis on the side away from the drum; and the liquid injecting means includes water injecting means fixed at such a position that a water ejected therefrom enters the liquid guide through the opening.

3. The spin extractor according to claim 1, characterized in that the speed controlling means controls the motor so that the drum is rotated at a speed where the centrifugal force acting on the laundry is smaller than the gravitational force acting thereon when the determining means determines that the position of the eccentric load is not in proximity to the position opposing the liquid holder in the drum in order to redistribute the laundry.

4. The spin extractor according to claim 1, characterized in that the speed controlling means controls the motor to rotate the drum at a high speed to carry out an extraction with no liquid held in the liquid holder when the magnitude of the eccentric load detected by the eccentric load detecting means is smaller than the preset value before the liquid is introduced into the liquid holder.

5. The spin extractor according to claim 1, characterized in that:

the liquid guide has a discharge port formed in the position opposing the introduction port; and the speed controlling means stops the drum with the liquid holder posed at the top thereof after the extracting operation is completed.

6. The spin extractor according to claim 1, characterized in that the liquid holder is formed in one of baffles provided in the drum.

7. The spin extractor according to claim 1, characterized in that:

the introduction port is located closer to the rotation axis of the drum than the liquid holder; and a conduit is formed to connect the introduction port and an inlet port formed in the liquid holder at the side facing the rotation axis of the drum.

8. The spin extractor according to claim 7, characterized in that the part of the conduit connected to the liquid holder is formed into a taper passage whose cross sectional area increases toward the liquid holder.

* * * * *